US006220066B1

(12) United States Patent
Häggström

(10) Patent No.: US 6,220,066 B1
(45) Date of Patent: Apr. 24, 2001

(54) LOCKING DEVICE

(75) Inventor: Åke Häggström, Lycksele (SE)

(73) Assignee: ASSA AB, Eskilstunna (SE)

( * ) Notice: Subject to any disclaimer, the term of this patent is extended or adjusted under 35 U.S.C. 154(b) by 0 days.

(21) Appl. No.: 09/254,425

(22) PCT Filed: Sep. 12, 1997

(86) PCT No.: PCT/SE97/01541

§ 371 Date: Mar. 10, 1999

§ 102(e) Date: Mar. 10, 1999

(87) PCT Pub. No.: WO98/11316

PCT Pub. Date: Mar. 19, 1998

(30) Foreign Application Priority Data

Sep. 16, 1996 (SE) ..... 9603365

(51) Int. Cl.[7] ..... E05B 25/00
(52) U.S. Cl. ..... 70/352; 70/387
(58) Field of Search ..... 70/352–355, 385–387

(56) References Cited

U.S. PATENT DOCUMENTS

| | | | | |
|---|---|---|---|---|
| 3,375,443 | * | 3/1968 | Tamura | 70/352 |
| 3,605,459 | * | 9/1971 | Van Dalen | 70/352 X |
| 3,762,192 | * | 10/1973 | Errani | 70/352 |
| 3,780,548 | * | 12/1973 | Anastasov | 70/352 |
| 4,287,737 | * | 9/1981 | Ahn | 70/352 X |
| 4,838,058 | * | 6/1989 | Matsumoto | 70/355 |
| 5,025,647 | * | 6/1991 | Muus | 70/352 |
| 5,146,770 | * | 9/1992 | Yun-Sheng | 70/387 X |
| 5,305,623 | * | 4/1994 | Kello | 70/352 X |
| 5,355,701 | * | 10/1994 | Tobias | 70/352 X |
| 5,469,723 | * | 11/1995 | Litwin et al. | 70/352 X |
| 5,606,881 | * | 3/1997 | Drake | 70/352 |
| 5,669,254 | * | 9/1997 | Lee | 70/387 X |
| 5,884,511 | * | 3/1999 | Preddey | 70/352 X |

FOREIGN PATENT DOCUMENTS

| | | | | |
|---|---|---|---|---|
| 1 960 523 | | 5/1974 | (DE) . | |
| 2848308 | * | 5/1980 | (DE) | 70/352 |
| 0 447 906 A2 | | 9/1991 | (EP) . | |
| 2148379 | * | 5/1985 | (GB) . | |
| 2176233 | * | 12/1986 | (GB) . | |
| 389 159 | | 10/1976 | (SE) . | |

* cited by examiner

*Primary Examiner*—Suzanne Dino Barrett
(74) *Attorney, Agent, or Firm*—Sughrue, Mion, Zinn, Macpeak & Seas, PLLC

(57) ABSTRACT

A locking device includes a housing or a casing (3) having an opening (8) for the insertion of a lock activating card (6). The locking device includes a cylinder lock (5) which actuates a catch hook, an intermediate member (2) which is connected to the catch hook through the medium of a latch pin (10), and a pin-like latch member (1) that restricts movement of the intermediate member and therewith also movement of the catch hook until a correct card (6) is inserted into the opening. The card (6) includes at least one hole **(6*a*) and the latch pin (1) can move perpendicularly to the card and therewith be received in the hole in said card, wherewith the latching effect of the latch pin is cancelled and the intermediate member is free to move. The latch pin (1)**, and therewith the card, is held fixed when the catch hook is swung out.

4 Claims, 3 Drawing Sheets

LOCKING DEVICE

FIELD OF INVENTION

The present invention relates to a locking device, and more particularly to a locking device based on the coin lock principle but instead using an element other than a coin in conjunction with locking and unlocking the lock.

Locking devices of this known kind are designed to function through the medium of a lock activating element, normally a coin. Such locks are known as coin locks.

Although locks of this kind find use in different applications, the use of such locks is relatively limited by virtue of the fact that the coin is collected by the locking device subsequent to the coin having performed its intended function, i.e. has allowed rotation of the catch hook and removal of the lock key in conjunction with renewed turning of the key to open the catch hook, therewith requiring a new coin to be inserted when again using the lock.

The present invention is based on the realization that the principle on which the coin lock is based can be further developed in a way to enable the comparatively simple, robust and reliable components of such a lock to be used in a more advanced manner that will widen the use possibilities of the lock principle.

OBJECTS OF THE INVENTION

Accordingly, it is an object of the present invention to provide on the basis of the coin lock principle a mechanically simple novel locking device with which an element other than a coin is used in conjunction with locking and unlocking the lock.

Another object is to provide a locking device of the aforesaid kind in which the element inserted into the lock mechanism to activate said mechanism can exhibit functions that provide the owner of said activating element with possibilities other than that of activating a locking device.

Still another object of the invention is to provide a locking device of the aforesaid kind which is activated by a separate activating element and which an attempt to force the lock, e.g. by damaging the activating element, will result solely in the catch hook being held in its locked state.

BACKGROUND OF THE INVENTION

Patent Publication DE-A-1 960 523 (Carl Maier+Cie) teaches an example of a lock in which, instead of a coin, there is used a punched card which is designed to receive a latching device. The arrangement presumes the use of a cam disc which can be rotated by means of a key and with which part of the peripheral surface of the disc functions in the manner of a latch bolt. This lock construction is highly complicated.

Patent Publication EP-B-0 447 906 (Tamura Plastic) describes a code lock for a bag, suitcase, or the like, said code lock including a plurality of waistless pins. These pins are not intended to coact with a displaceable intermediate member.

Patent Publication SE-B-389 159 (Glavna Direkzia Kbumkp Pri Sgns) teaches a code lock that includes a plurality of waisted pin-like elements that lack conical ends, said elements being referred to as "cylinders".

SUMMARY OF THE INVENTION

The aforesaid objects and other objects are fulfilled by a locking device of the aforedescribed kind wherein the lock activating element comprises a card which is operative to be inserted at least partially into the lock housing and which includes at least one hole; the latch member comprises a pin which includes a waist and has a conical tip and is operative to move against an action of a spring, the waist having a height slightly exceeding a thickness of the intermediate member. The latch pin is operative to move perpendicularly to the card such that when a correct card is inserted, the conical tip of the pin is operative to enter the hole in the card and therewith take a position in which the latching effect of the pin is canceled and the intermediate member is free to move; and when the locking member is swung out and a portion of the intermediate member is received in the waist part of the pin, the intermediate member functions to hold the pin and therewith the card so as to prevent removal of the card until the intermediate member has been moved out of engagement with the latch pin by turning the lock key.

The fact that the lock-insertable element has the form of a card, which is suitably of the same shape and size as other commercially available so-called plastic cards, provides a number of advantages. The card need only be provided with one or more holes that have been formed with substantially high precision and given the correct diameter.

Naturally, the lock may be constructed to function with cards of special quality and special shape and size.

The card may also incorporate a number of other functions, for instance a bar code, a microchip and/or a magnetic strip. For instance, when such a card is purchased for the purpose of obtaining entry to a locked area or space, such as a clothing locker in a swimming pool facility, the card may include other functions that enable the card holder to utilize other facilities and services, for instance admittance to different types of exclusive facilities in the building, such as sun beds, the fee for which is included in the cost of the card.

All such additional use of service possibilities can take place with the minimum of supervisory personnel, etc.

The card is held fixed in the inventive locking device until the catch hook is swung-in with the aid of the lock key.

The card may also be constructed so as to be readily destroyed should it be subjected to force in an attempt to force open the lock.

It is preferred in practice that the intermediate member will include a shoulder that engages with the latch pin so as to prevent movement of said intermediate member in the absence of a card or when the wrong card is inserted, but which can be accommodated in the waist part of the pin for movement relative to said pin when the correct card is inserted.

This also contributes towards the aforesaid simple and reliable design of the lock mechanism.

It is often sufficient to provide the card with only one hole. Security can be enhanced, however, by providing the card with two or more holes for coaction with a corresponding number of latch pins.

When the card is provided with two holes, these holes will suitably be positioned diagonally on the card. Because the latch pin has a conical tip, the hole or holes provided in the correct card must have the correct diameter.

The invention will now be described in more detail with reference to exemplifying embodiments thereof and also with reference to the accompanying schematic drawings.

DETAILED DESCRIPTION OF PREFERRED EMBODIMENTS

Figure 1:
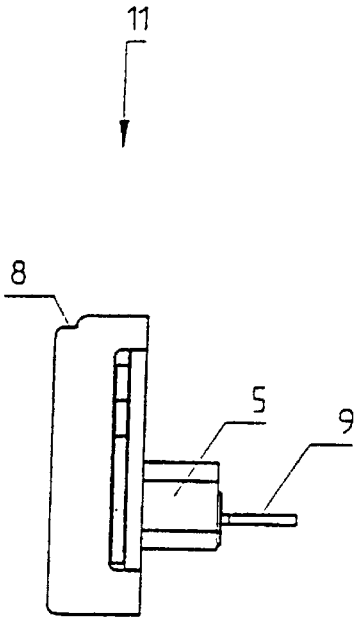
FIG. 1 is a end view of an inventive locking device that includes a cylinder lock, and shows a key inserted in the lock.
Figure 2:
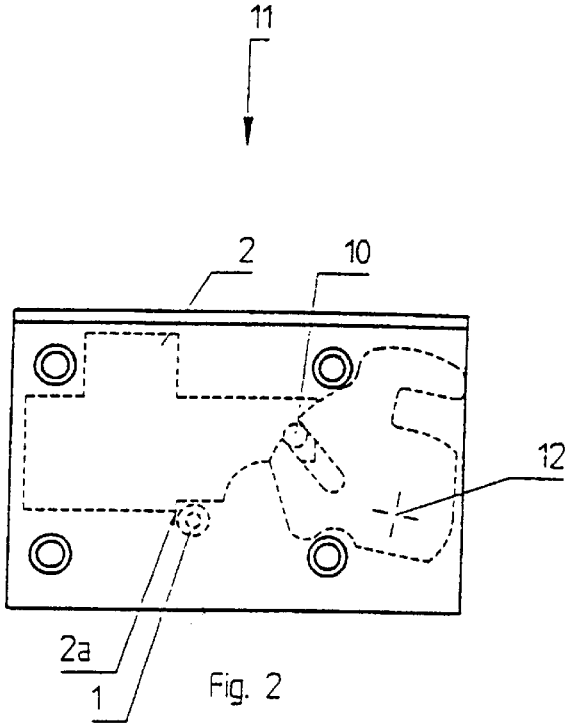
FIG. 2 is a side view of the locking device from the side thereof opposite the lock cylinder.
Figure 3:
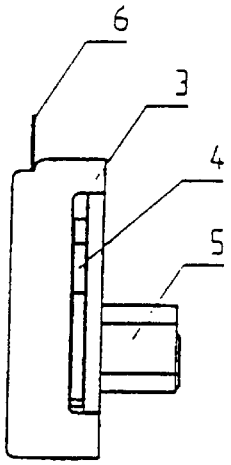
FIG. 3 is an end view corresponding to the view of FIG. 1 and shows the state of the device after a card has been inserted, the catch hook released and the key removed.
Figure 4:
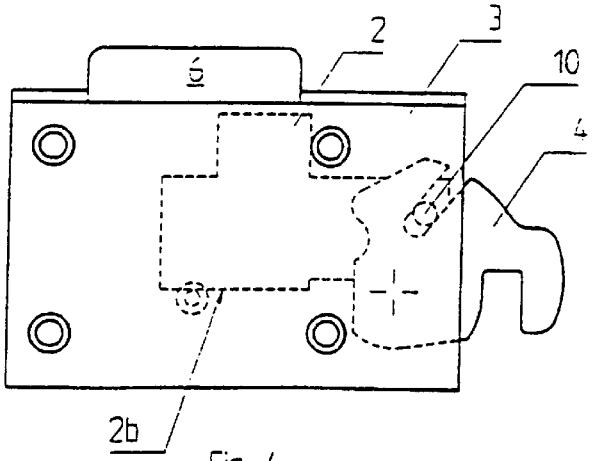
FIG. 4 is a side view corresponding to the view of FIG. 2 subsequent to completion of the events mentioned with respect to FIG. 3.

FIGS. 1–4 illustrate schematically the main components of an inventive card lock. The card lock is designated by the general reference numeral 11 and includes a housing or casing 3 provided with a slot or other opening 8 for the insertion of a lock activating card 6 of a size and shape typical for cash cards. The housing 3 includes a card accommodating opening 8 to this end. The locking device includes a pivotal locking member such as catch hook 4, and a cylinder lock 5, the lock key 9 of which can be removed by inserting a correct card in the card slot 8 and swinging the catch hook 4 to the latching position shown in FIG. 4 by means of the lock key 9. The catch hook is pivoted on a shaft 12 by means of dogging elements provided on the cylinder plug or core, in a typical manner.

An intermediate member 2 is connected to the catch hook 4 through the medium of a catch pin 10, such as to convert the pivotal movement of the catch hook into essentially rectilinear movement of the intermediate member 2 back and forth between rearward and forward end positions.

The lock mechanism also includes a latch means in the form of a pin 1 that coacts with the intermediate member 2, the catch hook 4, and the card 6. The function of the pin 1 will be described below in more detail with reference to FIGS. 5–7. The latch pin 1 functions to restrict movement of the intermediate member, and therewith also the catch hook, until a correct card 6 has been inserted into the slot 8. The latching effect of the latch pin 1 ceases when a correct card is inserted, so as to allow the catch hook 4 to be swung by the dogging element on the cylinder lock, and the intermediate member 2 therewith moved linearly between its two end positions. The latch pin 1 has a conical tip 1*a* with cone angle 1*e*. As the card 6 moves lightly into the card position in the slot 8, the latch pin 1 will move axially and compresses a coil spring 7 by virtue of the conical tip 1*a* of said pin. The latch pin is localized by means of sleeve-like guide elements 3*b* and 3*c* shown in FIG. 5.

Figure 5:
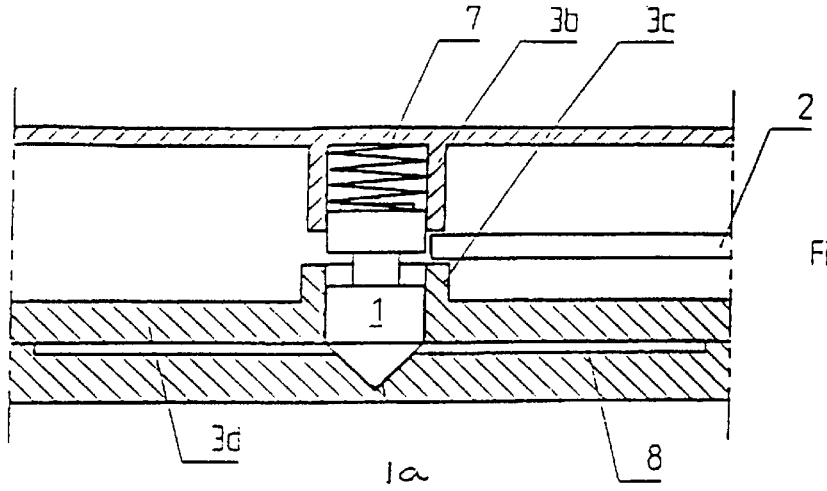
FIG. 5 is a part-sectional view that shows the position of a latch pin of the locking device when the pin is in a rest state, i.e. when no card is inserted.
Figure 6:
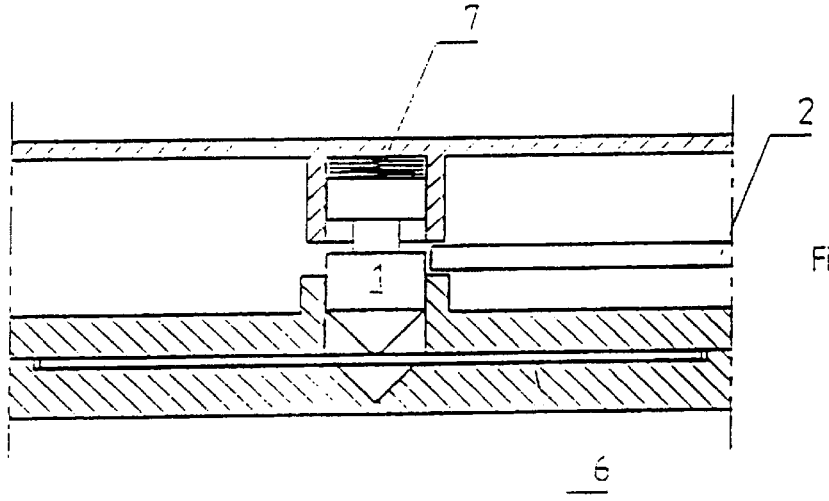
FIG. 6 is a sectional view corresponding to the view of FIG. 5 when the wrong card is inserted in the card slot of the locking device.
Figure 7:
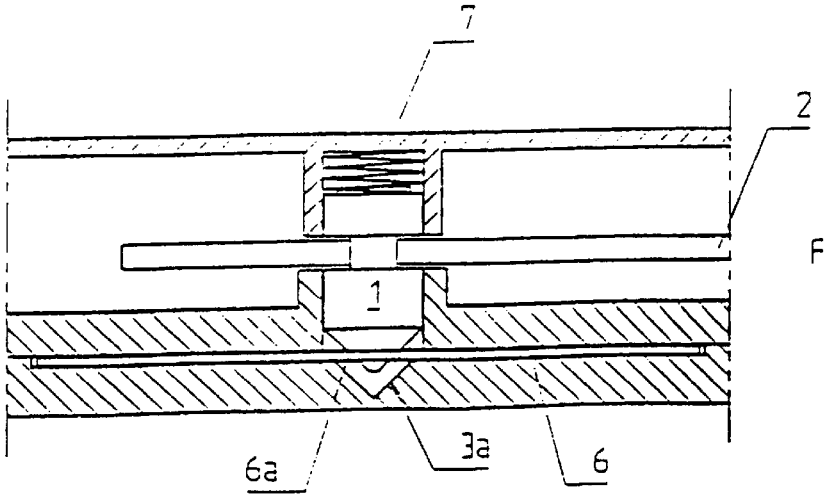
FIG. 7 is a sectional view corresponding to the views of FIGS. 5 and 6, showing the position of the latch pin when a correct card is inserted in the card slot.

As is evident from FIGS. 5–7, the latch pin 1 is movable perpendicularly to the plane of the card slot 8. When the correct card is inserted, shown in FIG. 7, the tip 1*a* of the latch pin 1 is able to enter the hole 6*a* in the card 6 and therewith take a position in which the latching effect of the latch pin ceases and the intermediate member is free to move.

Figure 8:
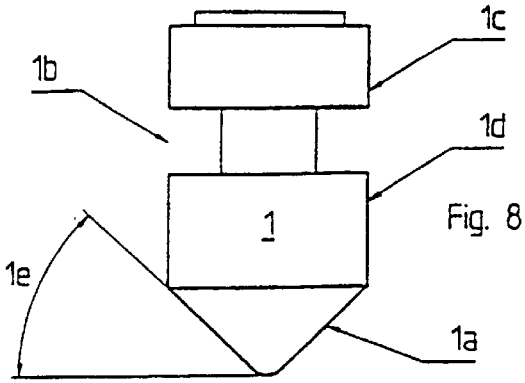
FIG. 8 is a side view of one embodiment of a latch pin.

As will be seen from FIG. 8, the latch pin 1 includes to this end a waist 1*b* whose height slightly exceeds the thickness of the card. The intermediate member 2 includes a shoulder 2*a* which engages the latch pin 1 so that in the absence of a card (FIG. 5) or when a wrong card is used (FIG. 6) prevents movement of the intermediate member. When the correct card is inserted (FIG. 7), the intermediate member can be received in the waist 1*b* of the latch pin 1 and therewith allow the intermediate member to move relative to the latch pin.

It will also be seen from FIG. 7 that when the catch hook 4 is swung outwardly, the part 2*b* of the intermediate member holds the latch pin 1 and therewith the card 6 fixed. This prevents removal of the card until the intermediate member has been moved out of engagement with the latch pin, by turning the lock key.

Figure 9:
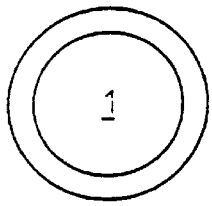
FIG. 9 shows the latch pin of FIG. 8 from above.

The preferred general embodiment of the latch pin is shown in FIGS. 8 and 9.

Figure 10:
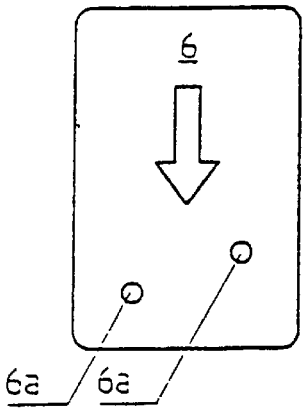
FIG. 10 illustrates from above a card provided with two holes positioned generally diagonally in relation to each other.
Figure 11:
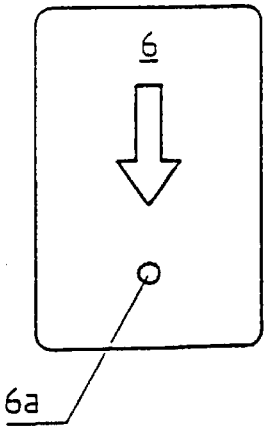
FIG. 11 illustrates a perforated card from above.

As will be evident from FIGS. 10 and 11, the card, which may have the conventional shape and size of a cash card, switch card or some like card, may include either one or two holes 6*a* for coaction with the latch pin.

Although a single hole will suffice in many instances, a greater degree of security against forcing of the lock is achieved when the card includes two or more holes 6*a*.

The card may also be provided with a bar code, a microchip, and/or a magnetic strip that will afford the card holder additional functions in accordance with that stated above.

The latch pin may have a configuration other than that described and illustrated. The intermediate member and other lock components may have forms different to that described and illustrated and may coact with the card in another way. All such design variants lie within the concept of the invention as defined in the following claims.

What is claimed is:

1. A locking device comprising:

a) a housing provided with an opening for insertion of a lock activating element;

b) a locking member pivotally mounted in said housing on a pivot axle;

c) a cylinder lock adapted for use with a lock key and being mounted on the outside of said housing and having a cylinder plug that carries a dogging element for pivoting the locking member when so permitted by insertion of the lock activating element into said opening;

d) an intermediate member which is connected to the locking member through a latch pin so as to convert pivotal movement of the locking member to generally rectilinear movement of the intermediate member back and forth between a rearward and a forward end position; and e) a latch member which coacts with the intermediate member, the locking member, and the lock activating element and which restricts movement of the intermediate member, and therewith also movement of the locking member, until a correct lock activating element has been inserted into the opening thereby to cancel a latching effect of the latch member and allow the locking member to be swung by the dogging element and the intermediate member to be displaced therewith between the rearward and the forward end positions, wherein:

the lock activating element comprises a card which is operative to be inserted at least partially into the housing and which includes at least one hole;

the latch member comprises a pin which includes a waist and has a conical tip and is operative to move against an action of a spring, said waist having a height slightly exceeding a thickness of the intermediate member;

the pin is operative to move perpendicularly to the card such that when a correct card is inserted, the conical tip of said pin is operative to enter the hole in said card and therewith take a position in which the latching effect of the pin is canceled and the intermediate member is free to move; and when the locking member is swung out and a portion of the intermediate member is received in the waist of the pin, the intermediate member functions to hold the pin and therewith the card so as to prevent removal of the card until the intermediate member has been moved out of engagement with the latch pin by turning the lock key.

2. The locking device according to claim 1, wherein the intermediate member includes a shoulder which functions to engage the pin so as to prevent movement of the intermediate member in the absence of a card or when an incorrect card is inserted, but which is operative to be received in the waist of the pin for movement relative to said pin when a correct card is inserted.

3. The locking device according to claim 1, wherein said locking member comprises a pivotal catch hook.

4. A locking device comprising:

a) a housing having an opening for insertion of a lock activating element;

b) a locking member swingably mounted in said housing;

c) a cylinder lock adapted for use with a lock key and being mounted to said housing and operative to swingably move said locking member;

d) an intermediate member having a latch pin which is slidably connected to said locking member so as to convert swinging movement of said locking member to generally rectilinear movement of said intermediate member;

e) a latch member which coacts with said intermediate member, said locking member, and the lock activating element and which restricts movement of said intermediate member, until a correct lock activating element has been inserted into said opening thereby to cancel a latching effect of said latch member and allow said locking member to swingably move and said intermediate member to in turn move back and forth; wherein said latch member comprises a biased pin having a waist portion and a tip portion, said waist portion being sized to permit reception of a portion of said intermediate member, said pin being operative to move perpendicularly to the lock activating member such that when a correct lock activating member is inserted, said tip portion of said pin is operative to enter a hole in the lock activating member and thereby cancel the latching effect of said pin and permit free movement of said intermediate member.

* * * * *